US007883618B2

(12) United States Patent
Claude et al.

(10) Patent No.: US 7,883,618 B2
(45) Date of Patent: Feb. 8, 2011

(54) RECYCLE OF OLEFINIC NAPHTHAS BY REMOVING AROMATICS

(75) Inventors: Alan Claude, Houston, TX (US); Anand Subramanian, Sugar Land, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 497 days.

(21) Appl. No.: 12/039,467

(22) Filed: Feb. 28, 2008

(65) Prior Publication Data

US 2009/0218255 A1 Sep. 3, 2009

(51) Int. Cl.
*C10G 51/02* (2006.01)
*B01J 8/24* (2006.01)

(52) U.S. Cl. ..... 208/67; 208/78; 208/113; 208/130; 208/314; 585/300; 585/302; 585/648; 585/652

(58) Field of Classification Search ..... 208/67, 208/78, 113, 130, 314; 585/300, 302, 648, 585/652

See application file for complete search history.

(56) References Cited

U.S. PATENT DOCUMENTS 3,647,682 A 3/1972 Rabo et al.
3,761,402 A * 9/1973 Atwood ..... 208/314
4,267,034 A 5/1981 Carter
4,404,095 A 9/1983 Haddad et al.
4,419,221 A 12/1983 Castagnos, Jr. et al.
4,828,679 A 5/1989 Cormier, Jr. et al.
4,980,053 A 12/1990 Li et al.
5,326,465 A 7/1994 Yongqing et al.
6,313,366 B1 11/2001 Ladwig et al.
6,388,161 B1 5/2002 Dath et al.
6,569,316 B2 5/2003 Winter
6,602,920 B2 8/2003 Hall et al.
6,635,792 B2 10/2003 Choi et al.
6,642,425 B2 11/2003 Winder et al.
6,652,737 B2 11/2003 Touvelle et al.
7,011,740 B2 3/2006 Tallman et al.

(Continued)

OTHER PUBLICATIONS

Cretoiu, Lucia, et al. "Sulfur Reduction With No Octane Loss-GT-DeSulf," ERTC Annual Meeting, Paris, France, Nov. 18-20, 2002.

(Continued)

*Primary Examiner*—Prem C Singh
(74) *Attorney, Agent, or Firm*—KBR IP Legal Dept.

(57) ABSTRACT

Systems and processes for producing one or more olefins. A feed containing 90% by weight or more $C_4$ and higher hydrocarbons can be cracked at conditions sufficient to provide an olefinic mixture and an aromatic mixture. The olefinic mixture can comprise 90% by weight or more $C_1$ to $C_3$ hydrocarbons. The aromatic mixture can comprise 90% by weight or more $C_4$ and higher hydrocarbons and one or more aromatics. The aromatic mixture can be contacted with one or more solvents to selectively separate at least a portion of the one or more aromatics therefrom to provide an aromatic-rich mixture and an aromatic-lean mixture. At least a portion of the aromatic-lean mixture can be recycled to the feed prior to cracking.

21 Claims, 2 Drawing Sheets

U.S. PATENT DOCUMENTS

| | | | | |
|---|---|---|---|---|
| 7,019,188 | B2 | 3/2006 | Smith et al. | |
| 7,128,827 | B2 | 10/2006 | Tallman et al. | |
| 7,144,498 | B2 | 12/2006 | McCall et al. | |
| 7,153,479 | B2 | 12/2006 | Peterson et al. | |
| 2005/0150817 | A1* | 7/2005 | Tallman et al. | 208/78 |
| 2006/0287561 | A1 | 12/2006 | Choi et al. | |
| 2007/0083071 | A1 | 4/2007 | Choi et al. | |

OTHER PUBLICATIONS

Gentry, Joseph C. and Fu-Ming Lee. "Novel Process for FCC Gasoline Desulfurization and Benzene Reduction to Meet Clean Fuels Requirements," 2000 NPRA Annual Meeting San Antonio, Texas, Mar. 27, 2000.

* cited by examiner

RECYCLE OF OLEFINIC NAPHTHAS BY REMOVING AROMATICS

BACKGROUND

1. Field

The present embodiments generally relate to methods for adjusting yields in olefin production. More particularly, embodiments of the present invention relate to methods for adjusting yields from high severity fluid catalytic cracking units.

2. Description of the Related Art

Olefins, which have long been desired as products in the petrochemical industry, have been used as feedstocks to produce a wide variety of finished products such as polyethylene, polypropylene, other polymers, alcohols, vinyl chloride monomer, and other petrochemicals. Olefins typically are produced by cracking longer molecular weight hydrocarbons found in crude oil, such as olefinic naphtha. Olefinic naphtha contains saturated, olefinic, and aromatic hydrocarbons in the $C_4$ to $C_{10}$ range. The majority of aromatics in the hydrocarbon feed are not converted in a cracking process, such as fluid catalytic cracking ("FCC"), which limits the production of desired products, such as linear olefins.

Standard solvents have been used to remove aromatics from the cracked hydrocarbons. Such solvents require saturating the olefins with hydrogen prior to removing the aromatics because the olefins are also soluble in the solvent. Thus, solvent extraction while effectively removing the undesirable aromatic compounds, also removes the desirable olefins, severely limiting product yield. Various extraction techniques have been used for specialized olefinic extractions as exemplified by U.S. Pat. Nos. 4,267,034 and 7,019,188. Research into the use of dimethyl sulfoxide as a solvent for the extraction of aromatics from mixed hydrocarbon streams is exemplified by: E. I. Shcherbina, et al., *Extractive Recovery of Aromatic Hydrocarbons from Pyronapthas with Dimethyl Sulfoxide*, translated from Khimiya i Tekhnologiya Topliv i Masel No. 6 pp. 13-16 (June, 1973).

There is a need, therefore, for a method for selectively removing aromatics from olefinic naphtha without removing or chemically altering the olefins present, thereby increasing olefin production.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for increasing olefin production are provided. In one or more embodiments, a feed containing 90% by weight (% wt) or more $C_4$ and higher hydrocarbons can be cracked or otherwise selectively separated at conditions sufficient to provide an olefinic mixture and an aromatic mixture. The olefinic mixture can contain 90% wt or more $C_1$ to $C_3$ hydrocarbons. The aromatic mixture can contain 90% wt or more $C_4$ and higher hydrocarbons and one or more aromatics. In one or more embodiments, at least a portion of the aromatic mixture can be contacted with one or more solvents to provide an aromatic-rich mixture and an aromatic-lean mixture. In one or more embodiments, at least a portion of the aromatic-lean mixture can be recycled to the feed prior to cracking.

Figure 1:
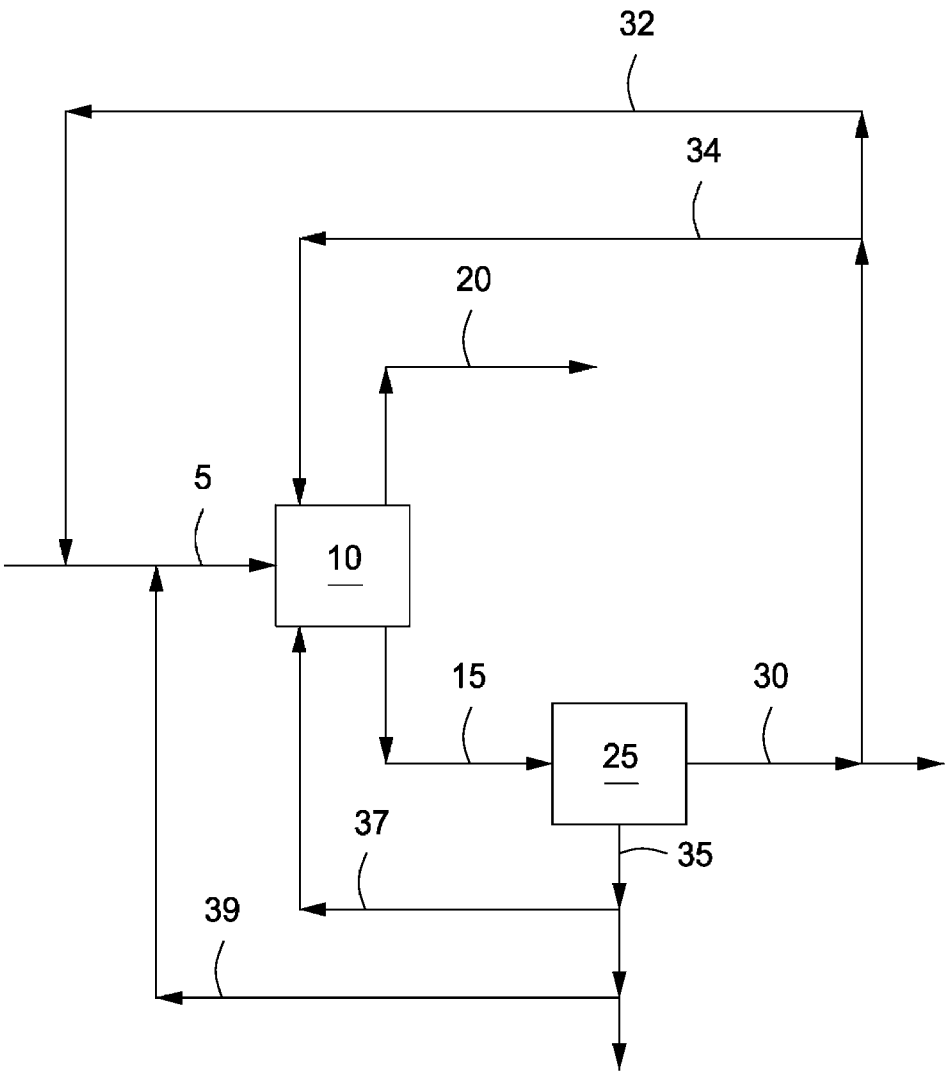
FIG. 1 depicts an illustrative system for producing one or more olefins according to one or more embodiments described.

FIG. 1 depicts an illustrative system for producing one or more olefins according to one or more embodiments. In one or more embodiments, a hydrocarbon feed via line 5 can be cracked or otherwise selectively separated using one or more separation units 10 operated at conditions sufficient to provide an olefinic mixture ("overhead") via line 20 and an aromatic mixture ("bottoms") via line 15. In one or more embodiments, the bottoms via line 15 can be contacted with one or more solvents in one or more separation systems 25 operated at conditions sufficient to provide an aromatic-rich mixture via line 30 and an aromatic-lean mixture via line 35. In one or more embodiments, the solvent can include, but is not limited to di-methyl sulfoxide, n-pyrrolidone, alkyl carbonates, derivatives thereof, or mixtures thereof.

In one or more embodiments, at least a portion of the aromatic-lean mixture in line 35 can be recycled via line 37 to the one or more separation units 10. In one or more embodiments, the aromatic-lean mixture in line 37 can be saturated with hydrogen, thereby permitting the conversion of paraffins to olefins or aromatics within the one or more separation units 10. In one or more embodiments, at least a portion of the aromatic-lean mixture can be recycled via line 39 to the feed in line 5 prior to introduction to the one or more separation units 10. In one or more embodiments, at least a portion of the aromatic-rich mixture can be recycled via line 32 to the feed in line 5 prior to introduction to the one or more separation units 10. In one or more embodiments, at least a portion of the aromatic-rich mixture can be recycled via line 34 to the one or more separation units 10.

The separation unit 10 can be any system, device, or combination of systems and/or devices suitable for selectively cracking, converting, reforming and/or separating one or more high and low molecular weight hydrocarbons. For example, the separation unit 10 can include one or more steam pyrolytic crackers, hydrocrackers, catalytic crackers, fluidized catalytic crackers, or any series and/or parallel combination thereof. In one example, the separation unit 10 can be one or more fluidized catalytic crackers each having a stacked reactor/regenerator, or one or more fluidized catalytic crackers each having a riser/reactor, a disengager, a stripper, and a regenerator. Suitable fluid catalytic cracker ("FCC") units are described in U.S. Pat. Nos. 3,647,682; 4,404,095; 4,419,221; 4,828,679; 4,980,053; 5,326,465; 7,011,740; 7,128,827; 7,144,498; and 7,153,479.

In one or more embodiments, the hydrocarbon feed via line 5 to the one or more separation units 10 can include 90% by weight or more $C_2$ and higher hydrocarbons. In one or more embodiments, the hydrocarbon feed via line 5 can include olefinic naphtha or paraffinic naphtha. In one or more embodiments, the hydrocarbon feed via line 5 can include one or more olefins. In one or more embodiments, the hydrocarbon feed via line 5 can include from about 0% wt to about 95% wt $C_4$ olefins, about 0% wt to about 95% wt $C_5$ olefins, from about 0% wt to about 95% wt $C_6$ olefins, and from about 0% wt to about 95% wt $C_7$ and higher olefins. (See note for paragraph 21)

In one or more embodiments, the overhead via line 20 can include one or more $C_1$ to $C_3$ hydrocarbons. For example, the overhead via line 20 can include 90% wt or more ethylene and/or propylene. In one or more embodiments, the overhead via line 20 can include 20% wt or more propylene. In one or more embodiments, the bottoms via line 15 can include one or more olefinic naphthas and one or more aromatics. In one or more embodiments, the bottoms via line 15 can include 90% wt or more $C_4$ and higher hydrocarbons and one or more aromatics. The term "naphtha" as used herein refers to a hydrocarbon mixture having a boiling point that can range from about 30° C. (85° F.) to about 240° C. (465° F.).

In one or more embodiments, the aromatic-lean mixture via line 35 can range from a low of about 5% wt or more, 30% wt or more, or 60% wt or more to a high of about 70% wt or more, 80% wt or more, or 90% wt or more olefins. In one or more embodiments, the aromatic-lean mixture via line 35 can include 50% wt or more olefins.

In one or more embodiments, about 1% wt to about 100% wt, about 25% wt to about 75% wt, or about 50% wt to about 100% wt, of the aromatic-lean mixture via line 37 can be recycled to the one or more separation units 10. In one or more embodiments, about 1% wt to about 100% wt, about 25% wt to about 75% wt, or about 50% wt to about 100% wt of the aromatic-lean mixture via line 39 can be recycled to the feed in line 5 prior to cracking the feed. Recycling at least a portion of the aromatic-lean mixture to the one or more separation units 10 can increase the olefin production, thereby increasing the propylene yield of the selectively separated feed.

In one or more embodiments, the aromatic-rich mixture via line 30 can include 70% wt or more $C_6$ and higher hydrocarbons. In one or more embodiments, the aromatic-rich mixture via line 30 can include 5% wt or more benzene, toluene, xylene, or combinations thereof. In one or more embodiments, the aromatic-rich mixture via line 30 can include 5% wt or more, 10% wt or more, 20% wt or more, or 30% wt or more benzene, toluene, xylene, or combinations thereof.

In one or more embodiments, about 1% wt to about 75% wt; about 1% wt to about 50% wt; or about 1% wt to about 25% wt of the aromatic-rich mixture via line 32 can be recycled to the feed via line 5. In one or more embodiments, about 1% wt to about 10% wt or more; about 1% wt to about 20% wt or more; or about 1% wt to about 40% wt or more of the aromatic-rich mixture via line 32 can be recycled to the feed via line 5. In one or more embodiments, about 1% wt to about 75% wt; about 1% wt to about 50% wt; or about 1% wt to about 25% wt of the aromatic-rich mixture via line 34 can be recycled to the one or more separation units 10. In one or more embodiments, about 1% wt to about 10% wt or more; about 1% wt to about 20% wt or more; or about 1% wt to about 40% wt or more of the aromatic-rich mixture via line 34 can be recycled to the one or more separation units 10. Recycling at least a portion of the aromatic-rich mixture via line 32 and/or 34 can increase olefin production. The aromatic-rich mixture can provide more hydrocarbon material for the separation unit 10 to selectively crack and/or separate into $C_1$ to $C_3$ hydrocarbons.

Figure 2:
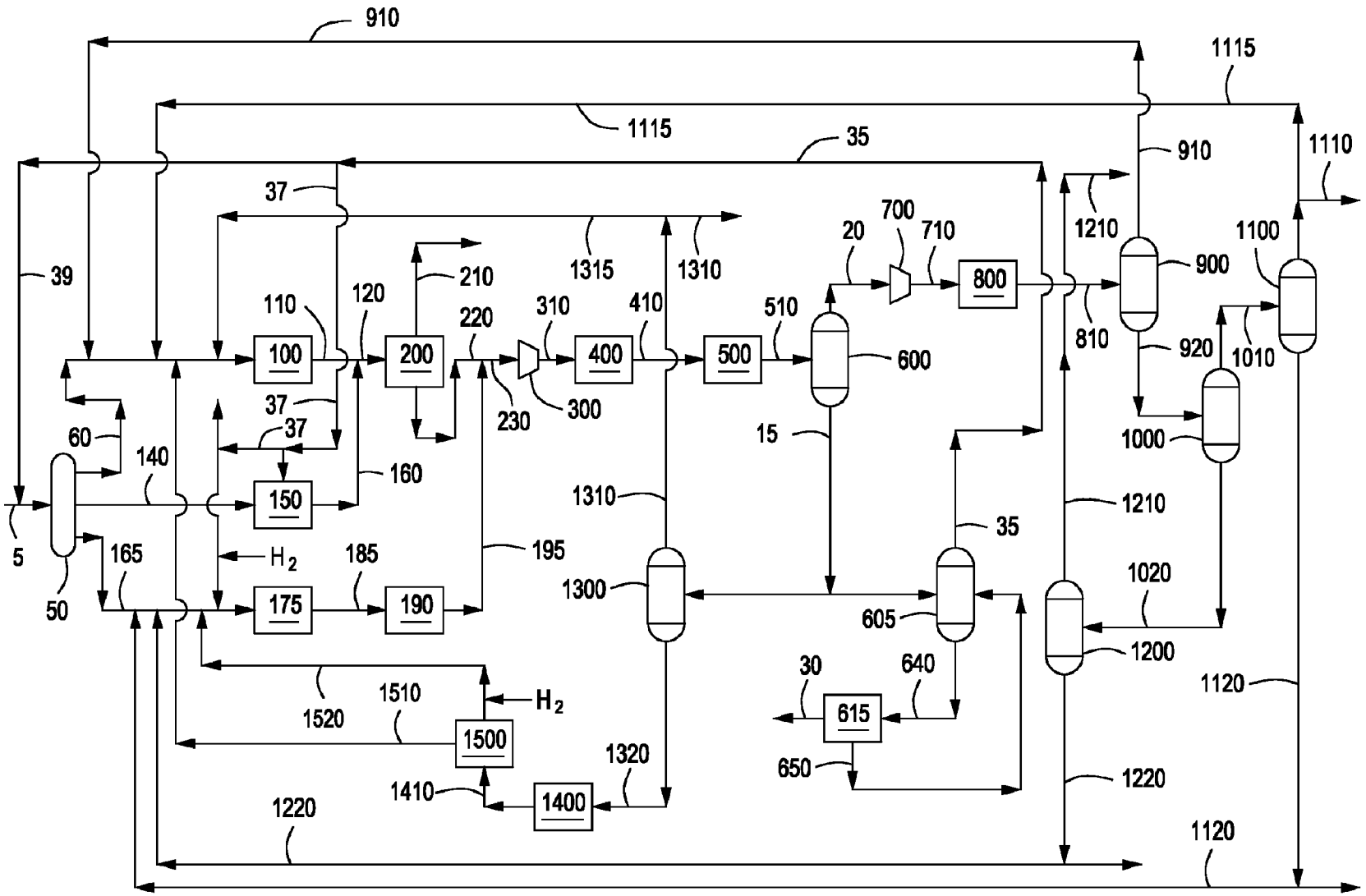
FIG. 2 depicts another illustrative system for producing one or more olefins according to one or more embodiments described.

FIG. 2 depicts another illustrative system for producing one or more olefins according to one or more embodiments. The system can include one or more pre-fractionators 50; one or more crackers (three are shown 100, 150, 175); one or more quench columns 190; one or more fractionators 200; one or more compressors (two are shown 300 and 700); one or more separation units 400; one or more drying units 500; one or more separation columns (six are shown 600, 900, 1000, 1100, 1200, and 1300 and 1500); one or more chill trains 800; one or more contactors 605; one or more recovery units 615; one or more hydrotreaters 1400 and one or more BTX units 1500. A hydrocarbon feed ("feed") via line 5 can be introduced to any one cracker 100, 150, 175, in parallel or series. The crackers 100, 150, 175 can be operated at conditions sufficient to either thermally or catalytically crack the hydrocarbon feed to provide an at least partially cracked hydrocarbon ("cracked hydrocarbon") via line 110.

In one or more embodiments, the hydrocarbon feed via line 5 can include, but is not limited to, one or more $C_2$ to $C_{12}$ alkanes, one or more $C_2$ to $C_{12}$ olefins, one or more gas oils, one or more full range gas oils, one or more resids, one or more decanted oils, one or more heavy catalytic cycle oils, one or more light catalytic cycle oils, $C_4$ Raffinate 1, $C_4$ Raffinate 2, TAME Raffinate, coker naphtha, cracker naphtha, ethylene plant naphtha, mixtures thereof, derivatives thereof, or combinations thereof. In one or more embodiments, the hydrocarbon feed via line 5 can be preheated prior to introduction to the pre-fractionator 50 and/or supplemental heat can be added to the pre-fractionator 50 to enhance the separation of the one or more hydrocarbons contained therein. In one or more embodiments, the hydrocarbon feed in line 5 can be heated to a temperature of from about 50° C. (120° F.) to about 300° C. (570° F.); from about 50° C. (120° F.) to about 250° C. (480° F.); or from about 50° C. (120° F.) to about 200° C. (390° F.). In some instances, like use in the Superflex™ process, the feed can be preheated to a temperature as high as about 540° C. Superflex™ process for light olefins originally developed by Arco Chemical Technology, Inc. (now Lyondell Chemical Company) and now licensed exclusively worldwide by Kellogg Brown and Root (KBR). This process uses a fluidized catalytic reactor system with a proprietary catalyst to convert low value, olefin-rich feedstocks, preferably in the carbon range of C4 to C8, into valuable propylene and ethylene products. The fluidized reactor system, very similar to a normal fluid catalytic cracking (FCC) unit, is composed of a riser reactor, regenerator, preheating system, and flue gas system. The fluidized design allows for continuous movement of catalyst between reactor and regenerator. From a typical feedstock of light FCC naphtha, the Superflex™ process can potentially provide ultimate yields of 40 wt % propylene and 20 wt % ethylene In one or more embodiments, the hydrocarbon feed in line 5 can be fractionated or otherwise selectively separated within the one or more pre-fractionators 50, providing one or more hydrocarbons via line 60, one or more refinery hydrocarbons line 140, and/or one or more alkanes via line 165. In one or more embodiments, the light hydrocarbons via line 60, one or more refinery hydrocarbons line 140, and/or one or more alkanes via line 165 can exit the pre-fractionator 50 at a temperature of from about 50° C. (120° F.) to about 400° C. (750° F.); from about 50° C. (120° F.) to about 350° C. (660°

F.); or from about 50° C. (120° F.) to about 300° C. (570° F.). In one or more embodiments, the hydrocarbons in line 60 can include one or more olefins. In one or more embodiments, the hydrocarbons in line 60 can include at least 90% $C_2$ and higher hydrocarbons. In one or more embodiments, the hydrocarbons via line 60 can include from about 0% wt to about 95% wt $C_4$ olefins, about 0% wt to about 95% wt $C_5$ olefins, from about 0% wt to about 95% wt $C_6$ olefins, and from about 0% wt to about 95% wt $C_7$ and higher olefins. The embodiments may be used with a steam cracker as one of the conversion units. Steam cracker feeds can range from Ethane (C2) up to naphtha components and do not contain any olefins. The embodiments will work for steam cracking furnaces as well as catalytic cracking units.

In one or more embodiments, the refinery hydrocarbons in line 140 can include, but are not limited to, one or more gas oils, one or more full range gas oils, one or more resids, one or more decanted oils, one or more heavy catalytic cycle oils, one or more light catalytic cycle oils, mixtures thereof, derivatives thereof and/or any combination thereof. In one or more embodiments, the refinery hydrocarbons in line 140 can include, but are not limited to, a mixture containing one or more hydrocarbons having normal boiling points within a temperature range of from about 200° C. (400° F.) to about 700° C. (1,290° F.); from about 200° C. (400° F.) to about 650° C. (1,200° F.), or from about 300° C. (570° F.) to about 700° C. (1,290° F.).

In one or more embodiments, the alkanes in line 165 can include, but are not limited to, one or more $C_2$ to $C_{12}$ alkanes, mixtures thereof, derivatives thereof, or any combination thereof. In one or more embodiments, the alkanes in line 165 can include ethane, propane, mixtures thereof, derivatives thereof, or any combination thereof.

The one or more pre-fractionators 50 can be any system, device, or combination of systems and/or devices suitable for selectively separating the hydrocarbon feed in line 5. In one or more embodiments, supplemental heat can be supplied to the pre-fractionator 50. In one or more embodiments, the pre-fractionator 50 can be a column containing one or more trayed sections, random packed sections, structured packed sections, in any frequency and/or combination. In one or more embodiments, the pre-fractionator 50 can be a partially or completely empty column. In one or more embodiments, the operating temperature of the pre-fractionator 50 can range from about 50° C. (120° F.) to about 400° C. (750° F.); from about 50° C. (120° F.) to about 350° C. (660° F.); or from about 50° C. (120° F.) to about 300° C. (570° F.). In one or more embodiments, the operating pressure of the pre-fractionator 50 can range from about 100 kPa (0 psig) to about 1,200 kPa (160 psig); about 200 kPa (15 psig) to about 1,000 kPa (130 psig); or about 200 kPa (15 psig) to about 800 kPa (100 psig).

In one or more embodiments, the hydrocarbons in line 60 can be introduced to one or more crackers 100 and cracked, combined, reformed and/or otherwise selectively separated therein to provide one or more cracked hydrocarbons via line 110. The cracked hydrocarbon via line 110 can include from about 30% wt to about 80% wt $C_2$ to $C_{10}$ hydrocarbons. In one or more embodiments, the cracked hydrocarbons in line 110 can include 5% wt or more propylene. In one or more embodiments, the cracked hydrocarbons in line 110 can include about 5% wt to about 25% wt $C_2$, about 5% wt to about 45% wt $C_3$, about 5% wt to about 50% wt $C_4$; or about 5% wt to about 50% wt $C_5$ and higher hydrocarbons.

The one or more cracker(s) 100 can be operated at a temperature of from about 425° C. (800° F.) to about 675° C. (1,250° F.), from about 450° C. (840° F.) to about 650° C. (1,200° F.), or from about 475° C. (890° F.) to about 600° C. (1,110° F.). In one or more embodiments, supplemental heat can be provided to the cracker(s) 100 or the hydrocarbons in line 60 can be pre-heated, using waste heat provided from downstream process fractionation or an external heat source such as a fired heater, to a temperature of from about 75° C. (170° F.) to about 400° C. (750° F.); or about 200° C. (400° F.) to about 375° C. (710° F.). (As noted previously, in some cases, such as with the Superflex™ process, the feed can be preheated to about 540° C. by from about 50° C. In one or more embodiments, all or a portion of the hydrocarbons in line 60 can be vaporized before being introduced into cracker 100. In one or more embodiments, about 10% vol to about 100% vol; about 25% vol to about 75% vol; or about 40% vol to about 60% vol of the hydrocarbons in line 60 can be vaporized prior to being introduced to the cracker(s) 100.

The one or more crackers 100 can be any system, device, or combination of systems and/or devices suitable for selectively cracking and/or separating one or more hydrocarbons. For example, each cracker 100 can be a steam pyrolytic cracker, a hydrocracker, a catalytic cracker, or a fluidized catalytic cracker. In one example, the cracker 100 can be a fluidized catalytic cracker that includes a stacked reactor/regenerator, or a fluidized catalytic cracker that includes a riser/reactor, a disengager, a stripper, and a regenerator. In one or more embodiments, at least two crackers 100 can operate in parallel or series. For example, the hydrocarbon feed via line 5 can be apportioned to at least two catalytic crackers 100, at least one fluid catalytic cracker 100 and at least one thermal cracker 100, or at least two pyrolytic crackers 100, arranged in parallel or series.

In one or more embodiments, the one or more crackers 100 can employ any catalyst useful in catalytic cracking. Illustrative catalysts include, but are not limited to Y-type zeolites, USY, REY, REUSY, faujasite, ZSM-5, or any combination thereof. In one or more embodiments, the catalyst to oil ratio can be from about 5:1 to about 70:1; from about 8:1 to about 25:1; or from about 12:1 to about 18:1. In one or more embodiments, regenerated fluidized catalyst can contact the hydrocarbons in line 60 at a temperature of from about 425° C. (800° F.) to about 825° C. (1,520° F.).

The term "light" as used herein refers to hydrocarbons containing a total of three (3) or fewer carbon atoms ($C_3$ and lower). The term "heavy naphtha" as used herein refers to a naphtha fraction with a boiling temperature of from about 165° C. (330° F.) to about 240° C. (465° F.).

The refinery feed via line 140 can be introduced to one or more crackers 150 to provide a cracked refinery feed via line 160. In one or more embodiments, the cracked refinery feed via line 160 can include 5% wt or more propylene. In one or more embodiments, at least a portion of the cracked refinery feed in line 160 can be mixed and/or combined with the cracked hydrocarbon in line 110 to provide one or more cracked hydrocarbons via line 120. The cracked refinery feed via line 160 can have a temperature of from about 200° C. (400° F.) to about 900° C. (1,650° F.); from about 300° C. (570° F.) to about 800° C. (1,470° F.); or from about 400° C. (750° F.) to about 700° C. (1,290° F.). In one or more embodiments, the cracked refinery feed via line 160 can include about 10% wt to about 40% wt; about 15% wt to about 40% wt; or about 20% wt to about 40% wt $C_2$ to $C_{10}$ hydrocarbons. In one or more embodiments, the cracked refinery feed via line 160 can include about 15% wt or less $C_2$, about 40% wt or less $C_3$, about 40% wt or less $C_4$, about 40% wt or less $C_5$, and about 60% wt or less $C_6$ and higher hydrocarbons.

The one or more crackers 150 can include any system, device or combination of systems and/or devices suitable for cracking and fractionating the refinery feed via line 140 to provide the cracked refinery feed via line 160. The cracker 150 can include, but is not limited to, one or more FCCs operated at conditions sufficient to selectively crack and or separate the refinery feed supplied via line 140. The one or more crackers 150 can operate at a temperature of from about 25° C. (80° F.) to 600° C. (1,110° F.); from about 50° C. (120° F.) to about 500° C. (930° F.); or from about 100° C. (210° F.) to about 400° C. (750° F.). In one example, the cracker 150 can be one or more FCCs having a stacked reactor/regenerator, and/or one or more FCCs having a riser/reactor, a disengager, a stripper, and a regenerator. In one or more embodiments, the one or more crackers 150 can employ any catalyst useful in catalytic cracking. Illustrative catalysts include, but are not limited to, Y-type zeolites, USY, REY, REUSY, faujasite, ZSM-5, and any combination thereof. In one or more embodiments, the catalyst to hydrocarbon ratio can be from about 5:1 to about 70:1; from about 8:1 to about 25:1; or from about 12:1 to about 18:1.

In one or more embodiments, the alkanes in line 165 can be cracked, decomposed or otherwise selectively separated using one or more crackers 175 to provide one or more cracked alkanes via line 185. In one or more embodiments, the cracked alkanes in line 185 can include, but are not limited to, one or more olefinic hydrocarbons. In one or more embodiments, the cracked alkanes via line 185 can include 5% wt or more propylene. The cracked alkanes via line 185 can be quenched in the quench column 190 to provide cooled cracked alkanes via line 195. The cracked alkanes in line 185 can include about 80% wt or less; about 60% wt or less; or about 40% wt or less ethylene and about 50% wt; about 30% wt; or about 10% wt or less propylene. The cracked alkanes in line 185 can exit the one or more crackers 175 at a temperature ranging from about 750° C. (1,380° F.) to about 800° C. (1,470° F.), from about 750° C. (1,380° F.) to about 850° C. (1,560° F.), or from about 750° C. (1,380° F.) to about 900° C. (1,650° F.). In one or more embodiments, integrating the operation of the one or more crackers 100, 150, 175, and quench columns 190 can increase the production of olefins in the separation unit.

In one or more specific embodiments, the alkane feed in line 165 can be introduced to the convection zone of the one or more steam pyrolytic crackers 175 at a temperature of from about 30° C. (85° F.) to about 200° C. (400° F.); about 100° C. (210° F.) to about 200° C. (400° F.); or about 150° C. (300° F.) to about 200° C. (400° F.). In one or more embodiments, the alkanes in line 165 can be heated in the convection zone of the one or more steam pyrolytic crackers 175 to a temperature of from about 250° C. (480° F.) to about 700° C. (1,290° F.); about 400° C. (750° F.) to about 700° C. (1,290° F.); or about 500° C. (930° F.) to about 700° C. (1,290° F.). In one or more embodiments, about 10% wt to 100% wt; about 50% wt to about 100% wt; or about 75% wt to about 100% wt of the alkanes in line 165 can be vaporized in the convection zone of the steam pyrolytic cracker 175.

The one or more crackers 175 can be any device suitable for cracking, converting, dehydrogenating, and selectively separating the alkane feed via line 165. In one or more embodiments, the cracker 175 can be steam pyrolytic cracker operating at a pressure of from about 100 kPa (15 psi) to about 3,000 kPa (435 psi); from about 500 kPa (75 psi) to about 3,000 kPa (435 psi); or from about 1,500 kPa (220 psi) to about 3,000 kPa (435 psi). In one or more embodiments, the weight ratio of steam-to-hydrocarbon fed to the one or more steam pyrolytic crackers 175 can range from about 1:1 to about 20:1; from about 2:1 to about 12:1; or from about 2:1 to about 6:1. In one or more embodiments, the one or more steam pyrolytic crackers 175 can operate at a temperature of from about 250° C. (480° F.) to about 700° C. (1,290° F.); from about 300° C. (570° F.) to about 600° C. (1,110° F.); or from about 350° C. (660° F.) to about 500° C. (930° F.). In one or more embodiments, the pyrolytic cracked feed via line 185 can exit the one or more pyrolytic crackers 175 at a temperature of about 200° C. (400° F.) to about 650° C. (1,200° F.); about 250° C. (480° F.) to about 550° C. (1,020° F.); or about 300° C. (570° F.) to about 450° C. (840° F.). In one or more embodiments, the pyrolytic cracked feed via line 185 can include from about 20% wt to about 60% wt ethylene and from about 5% wt to about 30% wt propylene.

The one or more quench columns 190 can be any system, device or combination of systems and/or devices suitable for quickly reducing the temperature of the cracked alkanes in line 185. In one or more embodiments, the one or more quench columns 190 can include internal packing, trays, rings, saddles, balls, irregular sheets, tubes, spirals, trays, baffles, or any combination thereof packing media to provide surface area for the cracked alkanes and a suitable heat transfer medium. In one or more embodiments, the cooled, cracked, alkanes in line 195 can have a temperature of from about 25° C. (80° F.) to about 200° C. (400° F.); about 35° C. (95° F.) to about 150° C. (300° F.); or about 40° C. (105° F.) to about 100° C. (210° F.).

Returning to the one or more crackers 100, the cracked hydrocarbons in line 120 can be fractionated or otherwise selectively separated using one or more fractionators 200 to provide a fractionated waste via line 210 and a fractionated olefin via line 220. In one or more embodiments, the fractionated waste via line 210 can contain heavy naphtha, light cycle oil, slurry oil, mixtures thereof, derivatives thereof, or combinations thereof. In one or more embodiments, the fractionated waste via line 210 can include $C_7$ to $C_{12}$ hydrocarbons. For example, the fractionated waste via line 210 can include from about 5% wt to about 50% wt $C_7$, from about 5% wt to about 50% wt $C_8$, from about 5% wt to about 50% wt $C_9$, and from about 5% wt to about 50% wt $C_{10}$ to $C_{12}$ hydrocarbons.

The fractionated olefin via line 220 can include one or more $C_2$ to $C_{10}$ olefins. In one or more embodiments, the fractionated olefin via line 220 can contain about 1% wt to about 99% wt; about 1% wt to about 75%; or from about 1% wt to about 50% wt $C_2$ to $C_{10}$ olefins. In one or more embodiments, the fractionated olefin via line 220 can include about 5% wt to about 95% wt $C_2$ olefins, about 5% wt to about 95% wt $C_3$ olefins, about 5% wt to about 95% wt $C_4$ olefins, about 5% wt to about 95% wt $C_5$ olefins, about 5% wt to about 95% wt $C_6$ olefins, and about 5% wt to about 95% wt $C_7$ and heavier olefins. The fractionated olefin via line 220 can include about 1% wt to about 45% wt; about 20% wt to about 75% wt; or about 30% wt to about 95% wt naphtha. In one or more embodiments, the fractionated olefin via line 220 can exit the fractionator 200 at pressures ranging from about 10 kPa (1 psi) to about 50 kPa (7 psi) or from about 20 kPa (3 psi) to about 50 kPa (7 psi).

The fractionator 200 can include any device suitable for selectively separating a mixed hydrocarbon to provide the fractionated waste via line 210 and the fractionated olefin via line 220. In one or more embodiments, the one or more fractionators 200 can separate light naphtha, heavy naphtha, light cycle oil, slurry oil, or any combination thereof from the cracked hydrocarbon via line 110 to provide the fractionated waste via line 210.

In one or more embodiments, at least a portion of the cooled cracked alkanes in line 195 can be combined with the fractionated olefin via line 220 to provide one or more fractionated olefins via line 230. In one or more embodiments, the pressure of the fractionated olefins in line 230 can be increased using one or more compressors 300 to provide a compressed olefin via line 310. The compressed olefin via line 310 can contain high pressure, partially or totally liquefied hydrocarbons. In one or more embodiments, all or a portion of the fractionated olefins in line 230 can be liquefied by compression using the one or more compressors 300. Such liquification of the fractionated olefins in line 230 can facilitate separation of contaminants including oxygenates, acid gases, water, or any combination thereof present in the fractionated olefin. In one or more embodiments, the acid concentration of the compressed olefin via line 310 can range from about 100 ppmv to about 5% vol total acid gas. In at least one specific embodiment, the compressed olefin via line 310 can be at a temperature of about 5° C. (40° F.) to about 100° C. (210° F.).

Considering the compressor 300 in more detail, the compressor 300 can include any device suitable for compressing a gas, liquid, or multiphase fluid. In one or more embodiments, the compressor 300 can be a reciprocating, rotary, axial flow, centrifugal, diagonal or mixed-flow, scroll, or diaphragm compressor. In one or more embodiments, the compressed olefin 310 can be at a pressure of about 100 kPa (15 psi) to about 3,000 kPa (435 psi); about 1,000 kPa (145 psi) to about 3,000 kPa (435 psi); or about 2,000 kPa (290 psi) to about 3,000 kPa (435 psi).

In one or more embodiments, the compressed olefin via line 310 can be introduced to one or more separation units 400 via line 310 to remove oxygenates, acid gases, water, or any combination thereof and to provide a separated olefin via line 410. The separated olefin via line 410 can include olefinic compounds, aromatic compounds, light and heavy naphtha compounds, mixtures thereof, derivatives thereof, or combinations thereof. In one or more embodiments, the separated olefin via line 410 can contain a hydrogen sulfide ("$H_2S$") concentration of about 0.1 ppmv to about 500 ppmv; about 0.1 ppmv to about 50 ppmv; or about 0.1 ppmv to about 1 ppmv. In one or more embodiments, the separated olefin via line 410 can contain a carbon dioxide ("$CO_2$") concentration of about 50 ppmv to about 500 ppmv; about 50 ppmv to about 250 ppmv; or about 50 ppmv to about 100 ppmv. In one or more embodiments, the separated olefin via line 410 can include one or more $C_2$ to $C_{10}$ olefins. In one or more embodiments, the separated olefin via line 410 can contain about 5% wt to about 99% wt; about 15% wt to about 95% wt; or about 20% wt to about 90% wt $C_2$ to $C_{10}$ olefins.

The one or more separation units 400 can include any system, device, or combination of systems and/or devices for removing oxygenates, acid gas, water, and other contaminants from one or more hydrocarbons, thereby providing the separated olefin via line 410. In one or more embodiments, the separation unit 400 can operate at a temperature of about 25° C. (80° F.) to about 400° C. (750° F.); about 25° C. (80° F.) to about 300° C. (570° F.); or about 25° C. (80° F.) to about 150° C. (300° F.). In one or more embodiments, the separation unit 400 can operate at a pressure of about 100 kPa (15 psi) to about 3,000 kPa (435 psi); about 1,000 kPa (145 psi) to about 3,000 kPa (435 psi); or about 2,000 kPa (290 psi) to about 3,000 kPa (435 psi).

In one or more embodiments, the separated olefin via line 410 can be dried in one or more drying units 500 to provide a dehydrated olefin via line 510. In one or more embodiments, the dehydrated olefin via line 510 can include olefinic compounds, aromatic compounds and naphtha compounds, mixtures thereof, derivatives thereof, or combinations thereof. In one or more embodiments, the dehydrated olefin via line 510 exiting the drying unit 500 can have a water concentration of about 0.1 ppmv $H_2O$ to about 50 ppmv $H_2O$; about 0.1 ppmv $H_2O$ to about 25 ppmv $H_2O$, or about 0.1 ppmv $H_2O$ to about 10 ppmv $H_2O$.

The one or more drying units 500 can include any system, device, or combination of systems and/or devices suitable for removing water from a hydrocarbon, providing the dehydrated olefins in line 510. In one or more embodiments, the drying unit 500 can include systems that use desiccants, solvents, heat, or any combination thereof to remove water from a hydrocarbon. In one or more embodiments, the drying unit 500 can operate at a temperature of about 25° C. (80° F.) to about 400° C. (750° F.); about 25° C. (80° F.) to about 300° C. (570° F.); or about 25° C. (80° F.) to about 150° C. (300° F.). In one or more embodiments, the drying unit 500 can operate at a pressure of about 100 kPa (15 psi) to about 3,000 kPa (435 psi); about 1,000 kPa (145 psi) to about 3,000 kPa (435 psi); or about 2,000 kPa (290 psi) to about 3,000 kPa (435 psi).

In one or more embodiments, the dehydrated olefin via line 510 can be referred to as a "treated olefin." In one or more embodiments, the compressor 300, separation unit 400, and dryer 500 are optional steps and can be performed in any order or with any combination. The treated olefin can refer to the fractionated olefin after being treated in one or more of the compressors 300, separation units 400, and dryers 500.

In one or more embodiments, the dehydrated olefin or treated olefin via line 510 can be introduced to one or more separators ("de-propanizers") 600, which can selectively separate the dehydrated olefin to provide an olefinic mixture via line 20 and an aromatic mixture via line 15. In one or more embodiments, the olefinic mixture via line 20 can contain $C_1$ through $C_3$ hydrocarbon compounds. In one or more embodiments, the aromatic mixture via line 15 can contain $C_4$ and higher hydrocarbons, including one or more olefinic naphthas. In one or more embodiments, the olefinic mixture via line 20 can include about 99% wt $C_1$ to $C_3$ hydrocarbons. In one or more embodiments, the olefinic mixture via line 20 can contain about 5% wt to about 50% wt $C_1$ compounds, about 5% wt to about 50% wt $C_2$ compounds, about 15% wt to about 70% wt $C_3$ compounds, and less than 10% wt hydrogen ("$H_2$").

In one or more embodiments, the aromatic mixture via line 15 can include less than 10% olefins, but in some cases can include upwards of 50% olefins. In one or more embodiments, the aromatic mixture via line 15 can contain about 1% wt to about 99% wt; about 50% wt to about 99% wt; or about 75% wt to about 99% wt $C_4$ to $C_{10}$ hydrocarbons. In one or more embodiments, the aromatic mixture via line 15 can include from about 40% wt to about 80% wt $C_4$ compounds, from about 10% wt to about 30% wt $C_5$ compounds, from about 5% wt to about 15% wt $C_6$ compounds, and less than about 15% wt $C_7$ and higher compounds. In one or more embodiments, the aromatic mixture via line 15 can include less than 50% wt, less than 25% wt, less than 10% wt, less than 5% wt, or less than 1% wt olefins.

The one or more de-propanizers 600 can include any system, device, or combination of systems and/or devices suitable for selectively separating the dehydrated olefin via line 510 to provide the olefinic mixture via line 20, which can contain $C_1$ to $C_3$ hydrocarbons, and the aromatic mixture via line 15, which can contain $C_4$ and higher hydrocarbons. In one or more embodiments, the de-propanizer 600 can include, but is not limited to one or more multi-staged columns having alternate segmental baffle trays, packing, perforated trays, or the like, or combinations thereof. In one or more embodiments, the de-propanizer 600 can be a full or partially open column without internals. In one or more embodiments, the de-propanizer 600 can operate at a temperature of from about 25° C. (80° F.) to about 400° C. (750° F.); from about 150° C. (300° F.) to about 400° C. (750° F.); or from about 300° C. (570° F.) to about 400° C. (750° F.). In one or more embodiments, the de-propanizer 600 can operate at a pressure of about 100 kPa (15 psi) to about 3,000 kPa (435 psi); about 1,000 kPa (145 psi) to about 3,000 kPa (435 psi); or about 2,000 kPa (290 psi) to about 3,000 kPa (435 psi).

In one or more embodiments, the olefinic mixture in line 20 can be compressed using one or more compressors 700 to provide a compressed olefinic mixture via line 710. In one or more embodiments, all or a portion of the olefinic mixture in line 710 can be liquefied. In one or more embodiments, the compressed olefinic mixture via line 710 can be cooled using one or more chill trains 800 to provide a cooled olefinic mixture via line 810, which can contain chilled, compressed hydrocarbons. In one or more embodiments, chilling the compressed olefinic mixture via line 710 can facilitate the separation of lighter hydrocarbons from heavier hydrocarbons.

In one or more embodiments, the compressor 700 can include any device suitable for compressing a gas, liquid, or multiphase fluid. For example, the compressor 700 can be a reciprocating, rotary, axial flow, centrifugal, diagonal or mixed-flow, scroll, or diaphragm compressor. In one or more embodiments, the compressed olefinic mixture via line 710 can be at a pressure of about 500 kPa (75 psi) to about 3,500 kPa (510 psi); about 1,000 kPa (145 psi) to about 3,500 kPa (510 psi); or about 2,500 kPa (365 psi) to about 3,500 kPa (510 psi). In one or more embodiments, the one or more compressors can include intercooling or after-cooling of the compressed olefinic mixture via line 710. In one or more embodiments, the compressed olefinic mixture via line 710 can be at a temperature of from about −20° C. (−70° F.) to about 200° C. (400° F.), from about 50° C. (120° F.) to about 150° C. (300° F.); or from about 100° C. (210° F.) to about 150° C. (300° F.).

The one or more chill trains 800 can include any system, device or combination of systems and/or devices suitable for decreasing the temperature of the compressed olefinic mixture in line 710, providing the cooled olefinic mixture via line 810. In one or more embodiments, the chill train 800 can include, but is not limited to liquid or air cooled shell and tube, plate and frame, fin-fan, or spiral wound cooler designs. In one or more embodiments, a cooling medium such as water, refrigerant, air, or combinations thereof can be used to remove the necessary heat from the compressed olefinic mixture via line 710 to provide the cooled olefinic mixture via line 810. In one or more embodiments, the one or more chill trains 800 can operate at a temperature of from about −40° C. (−105° F.) to about 100° C. (210° F.); from about −20° C. (−70° F.) to about 100° C. (210° F.); or from about 0° C. (30° F.) to about 100° C. (210° F.). In one or more embodiments, the one or more chill trains 800 can operate at a pressure of from about 500 kPa (73 psi) to about 3,500 kPa (510 psi); from about 1,000 kPa (145 psi) to about 3,500 kPa (510 psi); or from about 2,500 kPa (365 psi) to about 3,500 kPa (510 psi).

In one or more embodiments, the cooled olefinic mixture via line 810 can be selectively separated in one or more separators ("de-methanizers") 900 to provide a methane recycle feed via line 910 and a $C_2$-$C_3$ mixture via line 920. In one or more embodiments, the methane recycle feed via line 910 can contain $C_1$ compounds. In one or more embodiments, the methane recycle feed via line 910 can include about 10% wt to about 90% wt; about 15% wt to about 70% wt; or about 20% wt to about 50% wt methane. In one or more embodiments, the methane recycle feed via line 910 can include 35% wt to 40% wt methane. In one or more embodiments, the methane recycle feed via line 910 can have a pressure of from about 100 kPa (15 psi) to about 5,000 kPa (730 psi); from about 500 kPa (73 psi) to about 4,000 kPa (580 psi); or from about 800 kPa (115 psi) to about 3,000 kPa (435 psi). In one or more embodiments, the methane recycle feed via line 910 can be recycled to the hydrocarbon feed via line 60. Although not shown in FIG. 2, in one or more embodiments, the methane recycle via line 910 can be compressed using one or more compressors and at least a portion can be mixed with the hydrocarbon feed in line 60 and/or can be introduced directly to the one or more crackers 100.

Recycling at least a portion of the methane recycle feed via line 910 to the hydrocarbon feed via line 60 can improve the olefin yield within the cracker 100. The methane can add heating value to the one or more crackers and/or it can react to form longer chain hydrocarbons. Although not shown in FIG. 2, in one or more embodiments, at least a portion of the methane recycle in line 910 can be saturated with hydrogen and recycled to the steam pyrolytic cracker 175.

In one or more embodiments, the $C_2$-$C_3$ mixture via line 920 can contain $C_2$ and $C_3$ compounds. In one or more embodiments, the $C_2$-$C_3$ mixture via line 920, exiting the one or more de-methanizers 900, can include about 30% wt; about 40% wt; or about 50% wt or more $C_2$-$C_3$ hydrocarbons.

The one or more de-methanizers 900 can include any system, device or combination of systems and/or devices suitable for selectively separating the cooled olefinic mixture via line 810, which can contain chilled compressed hydrocarbons to provide the methane recycle feed via line 910, which can contain $C_1$ hydrocarbons, and the $C_2$-$C_3$ mixture via line 920, which can contain $C_2$ and higher hydrocarbons. In one or more embodiments, the de-methanizer 900 can include, but is not limited to one or more multi-staged columns having alternate segmental baffle trays, packing, perforated trays or the like, or combinations thereof. In one or more embodiments, the de-methanizer 900 can be an open or partially open column without internals. In one or more embodiments, the de-methanizer 900 can operate at a temperature of from about 25° C. (80° F.) to about 400° C. (750° F.); from about 150° C. (300° F.) to about 400° C. (750° F.); or from about 300° C. (570° F.) to about 400° C. (750° F.). In one or more embodiments, the de-methanizer 900 can operate at a pressure of from about 500 kPa (70 psi) to about 3,500 kPa (510 psi); from about 1,000 kPa (145 psi) to about 3,500 kPa (510 psi); or from about 2,500 kPa (365 psi) to about 3,500 kPa (510 psi).

In one or more embodiments, the $C_2$-$C_3$ mixture via line 920 can be selectively separated in one or more separators ("de-ethanizers") 1000 to provide a $C_2$-rich mixture via line 1010 and a $C_3$-rich mixture via line 1020. In one or more embodiments, the $C_2$-rich mixture via line 1010 can include $C_2$ compounds, including, but not limited to ethane and ethylene. In one or more embodiments, the $C_2$-rich mixture via line 1010 can include about 20% wt to about 70% wt; about 30% wt to about 60% wt; or about 40% wt to 50% wt ethane. In one or more embodiments, the $C_2$-rich mixture via line 1010 can include about 30% wt to about 80% wt; about 40% wt to about 70% wt; or about 50% wt to about 60% wt ethylene.

In one or more embodiments, the $C_3$-rich mixture via line 1020 can include about 99% wt or more $C_3$ hydrocarbons. In one or more embodiments, the $C_3$-rich mixture via line 1020 can include about 1% wt to about 50% wt; about 3% wt to about 30% wt; or about 5% wt to about 25% wt propane. In one or more embodiments, the $C_3$-rich mixture via line 1020 can include about 50% wt to about 99% wt; about 70% wt to about 97% wt; or about 75% wt to about 95% wt propylene.

Considering the one or more de-ethanizers 1000 in greater detail, each can include any system or device suitable for separating the $C_2$-$C_3$ mixture via line 920 to provide the $C_2$-rich mixture via line 1010, which can contain $C_2$ hydrocarbons, and the $C_3$-rich mixture via line 1020, which can contain $C_3$ hydrocarbons. In one or more embodiments, the de-ethanizer 1000 can include one or more multi-staged columns having alternate segmental baffle trays, packing, perforated trays or the like, or combinations thereof. In one or more embodiments, the de-ethanizer 1000 can be an open or partially open column. In one or more embodiments, the de-ethanizer 1000 can operate at a temperature of from about 25° C. (80° F.) to about 400° C. (750° F.); from about 150° C. (300° F.) to about 400° C. (750° F.); or from about 300° C. (570° F.) to about 400° C. (750° F.). In one or more embodiments, the de-ethanizer 1000 can operate at a pressure of from about 100 kPa (15 psi) to about 4,000 kPa (580 psi); from about 1,000 kPa (145 psi) to about 4,000 kPa (580 psi); or from about 2,000 kPa (290 psi) to about 4,000 kPa (580 psi).

In one or more embodiments, one or more separators ("$C_2$ splitters") 1100 can be used to selectively separate the $C_2$-rich mixture via line 1010 to provide an ethylene-rich product via line 1110, which can contain ethylene, and a ethane-rich recycle via line 1120, which can contain ethane. In one or more embodiments, the ethylene-rich product via line 1110 can include 95% wt or more ethylene. In one or more embodiments, the ethylene-rich product via line 1110 can include about 60% wt to about 99.9% wt; about 75% to about 99.9% wt; or about 95% wt to about 99.9% wt ethylene.

In one or more embodiments, the ethane-rich recycle via line 1120 can include about 85% wt to about 95% wt ethane. In one or more embodiments, the ethane-rich recycle via line 1120 can include about 60% wt to about 99.9% wt; about 75% to about 99.9% wt; or about 95% wt to about 99.9% wt ethane. In one or more embodiments, at least a portion of the ethane-rich recycle in line 1120 can be removed from the system to control buildup of ethane, which acts an inert in the separation system.

In one or more embodiments, at least a portion of the ethylene-rich product via line 1110 can be introduced to line 1115 to provide an ethylene-rich recycle. In one or more embodiments, about 1% vol to about 100% vol; about 20% vol to about 80% vol; or about 30% vol to about 60% vol of the ethylene-rich product via line 1110 can be recycled to the one or more crackers 100 via line 1115. At least a portion of the ethylene-rich recycle via line 1115 can be recycled to the hydrocarbon feed via line 5 prior to selectively separating the hydrocarbon feed. Recycling at least a portion of the ethylene-rich product via line 1110 to the one or more crackers 100 can suppress ethylene production in the one or more crackers 100. In one or more embodiments, recycling the ethylene-rich product via line 1110 to the cracker 100 can increase the olefin yield in the cracked hydrocarbon via line 110. In one or more embodiments, recycling 20% wt of the ethylene-rich product via line 1110 to the one or more crackers 100 can provide a relative increase in olefins of about 3% wt to about 7% wt. Although not shown in FIG. 2, in one or more embodiments, hydrogen can be added to at least a portion of the ethylene-rich recycle in line 1115 and the resultant mixture introduced to the one or more steam pyrolytic crackers 175.

The one or more $C_2$ splitters 1100 can include any system, device or combination of systems and/or devices suitable for separating the $C_2$-rich mixture via line 1010 to provide the ethylene-rich product via line 1110, which can include ethylene, and the ethane-rich recycle via line 1120, which can include ethane. In one or more embodiments, the $C_2$ splitter 1100 can include one or more multi-staged columns having alternate segmental baffle trays, packing, perforated trays or the like, or combinations thereof. In one or more embodiments, the $C_2$ splitter 1100 can be an open or partially open column. In one or more embodiments, the $C_2$ splitter 1100 can operate at a temperature of from about 25° C. (80° F.) to about 400° C. (750° F.); from about 150° C. (300° F.) to about 400° C. (750° F.); or from about 300° C. (570° F.) to about 400° C. (750° F.). In one or more embodiments, the C2 splitter 1100 can operate at a pressure of from about 100 kPa (15 psi) to about 4,000 kPa (580 psi); from about 1,000 kPa (145 psi) to about 4,000 kPa (580 psi); or from about 2,000 kPa (290 psi) to about 4,000 kPa (580 psi).

In one or more embodiments, the $C_3$-rich mixture via line 1020, which can contain hydrocarbons, can be selectively separated using one or more separators ("$C_3$ splitters") 1200 to provide a propylene-rich product via line 1210, which can contain propylene, and a propane-rich recycle via line 1220, which can contain propane. In one or more embodiments, the propylene-rich product via line 1210 can include about 95% wt propylene. In one or more embodiments, the propylene-rich product via line 1210 can include about 60% wt to about 99.9% wt; about 75% to about 99.9% wt; or about 95% wt to about 99.9% wt propylene. In one or more embodiments, the propane-rich recycle via line 1220 can include about 60% wt to about 99.9% wt; about 75% to about 99.9% wt; or from about 95% wt to about 99.9% wt propane. Recycling at least a portion of the propane-rich product via line 1220 to the one or more crackers 100 can suppress propane production in the one or more crackers 100. In one or more embodiments, at least a portion of the propane-rich recycle in line 1220 can be removed from the system to control buildup of propane, which acts as an inert within the separation system.

The one or more $C_3$ splitters 1200 can include any system, device or combination of systems and/or devices suitable for separating the $C_3$-rich mixture via line 1020 to provide the propylene-rich product via line 1210, which can contain propylene, and the propane-rich recycle via line 1220, which can contain propane. In one or more embodiments, the $C_3$ splitter 1200 can include one or more multi-staged columns having alternate segmental baffle trays, packing, perforated trays, or the like, or combinations thereof. In one or more embodiments, the $C_3$ splitter 1200 can be an open or partially open column. In one or more embodiments, the $C_3$ splitter 1200 can operate at a temperature of from about 25° C. (80° F.) to about 400° C. (750° F.); from about 150° C. (300° F.) to about 400° C. (750° F.); or from about 300° C. (570° F.) to about 400° C. (750° F.). In one or more embodiments, the $C_3$ splitter 1200 can operate at a pressure of from about 100 kPa (15 psi) to about 4,000 kPa (580 psi); from about 1,000 kPa (145 psi) to about 4,000 kPa (580 psi); or from about 2,000 kPa (290 psi) to about 4,000 kPa (580 psi).

In one or more embodiments, at least a portion of the aromatic mixture via line 15 can be introduced to one or more gasoline splitters 1300 to provide a low aromatics content mixture via line 1310, which can contain $C_4$ and heavier hydrocarbons in the naphtha boiling range, and a high aromatics mixture via line 1320, which can contain primarily $C_6$ and higher hydrocarbons. In one or more embodiments, the light-aromatic mixture via line 1310 can include from about 5% wt to about 80% wt olefins in the $C_4$ through the naphtha boiling range. In one or more embodiments, the low aromatics mixture via line 1310 can include from about 5% wt to about 65% wt $C_4$ to $C_5$ olefins and from about 5% wt to about 40% wt $C_6$ and heavier olefins. In one or more embodiments, the low aromatics mixture via line 1310 can include up to 30% wt of one or more $C_4$ to $C_6$ olefins.

In one or more embodiments, at least a portion of the low aromatics mixture via line 1315 can be recycled to the hydrocarbon feed in line 5 prior to selectively separating the hydrocarbon feed. Although not shown in FIG. 2, in one or more embodiments, at least a portion of the low aromatics mixture via line 1315 can be recycled directly to the cracker 100. In one more embodiments, at least a portion of the low aromatics stream in line 1310 can be removed to control the accumulation of paraffins and/or aromatics within the system 100. Alternatively, this purge stream can be saturated with the addition of hydrogen and recycled to a cracking unit designed to convert paraffins to the desired olefin products. In one or more embodiments, about 55% wt to about 95% wt about 65% wt to about 95% wt; or about 85% wt to about 95% wt of the low aromatics mixture via line 1310 can be recycled to the hydrocarbon feed in line 5, the cracker 180, or both via line 1315. In one or more embodiments, about 10% wt to about 50% wt; about 15% wt to about 50% wt; or about 30% wt to about 50% wt of low aromatics mixture via line 1310 can be recycled to the hydrocarbon feed in line 5, the cracker 100, or both via line 1315. Recycling at least a portion of the low aromatics mixture via line 1315 can increase the propylene production in the process, thereby increasing the propylene yield in the cracked hydrocarbon via line 110. The low aromatics mixture can provide more hydrocarbon materials in the feed which can be selectively cracked and/or separated into $C_1$ to $C_3$ hydrocarbons.

In one or more embodiments, the gasoline via line 1320 can include about 95% wt or less $C_4$ to $C_6$ hydrocarbons and about 95% wt or less $C_6$ and higher hydrocarbons. In one or more embodiments, the gasoline via line 1320 can include $C_6$ and higher hydrocarbons. In one or more embodiments, the gasoline via line 1320 can include 1% wt or more $C_4$, 5% wt or more $C_5$, 5% wt or more $C_6$, 5% wt or more $C_7$, and 5% wt or more $C_8$ and heavier hydrocarbons. In one or more embodiments, the gasoline via line 1320 can include about 1% wt to about 50% wt $C_4$; about 5% wt to about 50% wt $C_5$; about 5% wt to about 50% wt $C_6$; about 5% wt to about 50% wt $C_7$; and about 5% wt to about 50% wt $C_8$ and higher hydrocarbons.

The one or more gasoline splitters 1300 can include any system, device, or combination of systems and/or devices suitable for selectively separating aromatic compounds from the aromatic mixture via line 15. In one or more embodiments, the gasoline splitter 1300 can operate at a temperature of from about 25° C. (80° F.) to about 400° C. (750° F.); from about 150° C. (300° F.) to about 400° C. (750° F.); or from about 300° C. (570° F.) to about 400° C. (750° F.). In one or more embodiments, the gasoline splitter 1300 can operate at a pressure of from about 100 kPa (15 psi) to about 3,000 kPa (435 psi); from about 1,000 kPa (145 psi) to about 3,000 kPa (435 psi); or from about 2,000 kPa (290 psi) to about 3,000 kPa (435 psi).

As alternative embodiments, normal flow is to a naphtha splitter to generate C4 to C6 Non-Aromatic Hydrocarbons; C6 Aromatics (such as benzene) and higher boiling hydrocarbons; C4 to C6 non-aromatic olefin rich hydrocarbons (which can be recycled to a cracking unit); and C6 and higher boiling hydrocarbons (which can flow to the aromatics extraction unit). Low aromatics can be recycled to the cracker along with the C4 to C6 non-aromatic hydrocarbons. High aromatics can be sent for aromatics processing, gasoline blending, or the like. In this scenario, a considerable amount of C6 to 240° C. boiling hydrocarbons (Naphtha End-Point) can be recycled to the cracker along with the C4 to C6 non-aromatic hydrocarbons. If the aromatics are removed from this, portion of the naphtha, the olefins present in this material can be recycled and further cracked to produce more propylene (and ethylene).

In one or more embodiments, the gasoline via line 1320 can be stabilized using one or more hydrotreaters 1400 to provide a hydrotreated gasoline via line 1410, which can contain treated hydrocarbons. In one or more embodiments, the hydrotreated gasoline via line 1410 can include 5% wt or more $C_6$ and higher hydrocarbons. In one or more embodiments, the hydrotreated gasoline via line 1410 can contain about 5% wt to about 50% wt $C_6$; about 5% wt to about 50% wt $C_7$; and about 5% wt to about 50% wt $C_8$ and higher hydrocarbons.

Considering the hydrotreater 1400 in more detail, the gasoline hydrotreater 1400 can include any system or device suitable for stabilizing, a hydrocarbon. Illustrative systems can include treating with hydrogen to provide a hydrotreated gasoline with reduced di-olefins content. In one or more embodiments, the hydrotreater 1400 can operate at a temperature of from about 25° C. (80° F.) to about 400° C. (750° F.); from about 150° C. (300° F.) to about 400° C. (750° E); or from about 300° C. (570° F.) to about 400° C. (750° F.). In one or more embodiments, the hydrotreater 1400 can operate at a pressure of from about 100 kPa (15 psi) to about 4,000 kPa (580 psi); from about 1,000 kPa (145 psi) to about 4,000 kPa (580 psi); or from about 2000, kPa (290 psi) to about 4,000 kPa (580 psi). The hydrotreater 1400 can be upstream of the naphtha splitter unit 1300, thereby allowing the diolefins to be removed before the olefins are recycled to the cracking unit.

The hydrotreated gasoline via line 1410 can be introduced to one or more BTX units 1500, to provide a BTX-rich product via line 1510, and a BTX-lean product via line 1520. The acronym "BTX" as used herein refers to an aromatic hydrocarbon mixture which can contain benzene, toluene, xylene, or any mixture thereof. In one or more embodiments, both the BTX-rich product via line 1510 and BTX-lean product via line 1520 can contain benzene, toluene, xylene, mixtures thereof, or combinations thereof. In one or more embodiments, a portion of the BTX-rich product via line 1510 can be recycled to the hydrocarbon feed in line 60. Although not shown in FIG. 2, in one or more embodiments, a portion of the BTX-rich product via line 1510 can be recycled directly to the one or more crackers 100. At least a portion of the BTX-lean product via line 1520 can be recycled to the alkanes in line 165. In one or more embodiments, hydrogen can be added to at least a portion of the BTX-lean product in line 1520 prior to mixing with the alkanes in line 165.

Considering the one or more BTX units 1500 in greater detail, each BTX unit 1500 can include any system suitable for removing aromatic hydrocarbons from a feed which can contain mixed hydrocarbons. The BTX-rich product via line 1510 can contain about 5% wt to about 50% wt; about 5% wt to about 30% wt; or about 5% to about 15% wt BTX. In one or more embodiments, about 1% wt to about 50% wt; about 1% wt to about 25% wt; or about 1% wt to 10% wt of the BTX-rich product via line 1510 can be recycled to the hydrocarbon feed in line 60, cracker 100, or both. In one or more specific embodiments, about 50% wt or less of the BTX-rich product via line 1510 can be recycled to the hydrocarbon feed in line 60, cracker 100, or both via line 1510.

In one or more embodiments, at least a portion of the ethane-rich recycle via line 1120 can be recycled to the alkanes in line 165. In one or more embodiments, at least a portion of the propane-rich recycle via line 1220, which can contain propane, can be recycled to the alkanes in line 165. While not shown, in one or more embodiments, at least a portion of the ethane-rich recycle via line 1120 and the propane-rich recycle via line 1220 can be recycled directly into one or more steam pyrolytic crackers 175. In one or more embodiments, about 60% vol to 100% vol; about 70% vol to 100% vol; or about 90% vol to 100% vol of the ethane-rich recycle via line 1120 and about 60% vol to 100% vol; about 70% vol to 100% vol; or about 90% vol to 100% vol of the propane-rich recycle via line 1220 can be recycled to the alkane feed in line 165. In one or more embodiments, about 15% vol to about 55% vol; about 30% vol to about 55% vol; or about 40% vol to about 55% vol of the propane-rich recycle via line 1220 can be recycled directly to the one or more steam pyrolytic crackers 175. In one or more specific embodiments, about 15% vol to about 55% vol; about 30% vol to about 55% vol; or about 40% vol to about 55% vol of the ethane-rich recycle via line 1120 can be recycled directly to the one or more steam pyrolytic crackers 175.

In one or more embodiments, the one or more separation systems 25 (ref. FIG. 1) can include one or more contactors 605 and one or more recovery units 615. In one or more embodiments, at least a portion of the aromatic mixture via line 15, which can contain $C_4$ and higher hydrocarbons can be introduced to the one or more contactors 605. In one or more embodiments, the contactor 605 can contact the aromatic mixture with a solvent to provide an aromatic-rich mixture via line 640 and an aromatic-lean mixture via line 35. Illustrative solvents can include, but are not limited to, one or more of the following: di-methyl sulfoxide, n-pyrrolidone, alkyl carbonates, mixtures thereof, derivatives thereof, or any combination thereof. The aromatic-rich mixture can include, but is not limited to, one or more solvents and aromatic hydrocarbons. In one or more embodiments, at least a portion of the aromatic-lean mixture in line 35 can be recycled via line 39 to the hydrocarbon feed in line 5. In one or more embodiments, at least a portion of the aromatic-lean mixture in line 35 can be recycled via line 37 to the one or more crackers 150. In one or more embodiments, at least a portion of the aromatic-lean mixture in line 37 can be saturated with hydrogen and introduced to the steam pyrolytic cracker 175. In one or more embodiments, about 55% to about 95%; about 65% to about 85%; or about 80% to about 90% of the aromatic-lean mixture via line 39 can be recycled to the hydrocarbon feed in line 5. In one or more embodiments, about 55% to about 95%; about 65% to about 85%; or about 80% to about 90% of the aromatic-lean mixture via line 37 can be recycled to the one or more crackers 150. In one or more embodiments, about 1% wt to about 90% wt; about 1% wt to about 65% wt; or about 1% wt to about 45% wt, of the aromatic-lean mixture via line 39 can be recycled to the hydrocarbon feed in line 5. In one or more embodiments, about 1% wt to about 90% wt; about 1% wt to about 65% wt; or about 1% wt to about 45% wt, of the aromatic-lean mixture via line 37 can be recycled to the one or more crackers 150.

In one or more embodiments, the aromatic-lean mixture via line 35 can include about 1% wt to about 99% wt; about 50% wt to about 95% wt; or about 70% wt to about 90% wt olefins. The aromatic-lean mixture via line 35 can include less than 10% wt, less than 5% wt, or less than 1% wt aromatics. The aromatic-lean mixture via line 35 can include about 5% wt to about 95% wt $C_4$ olefins, about 5% wt to about 95% wt $C_5$ olefins, and about 5% wt to about 95% wt $C_6$ and heavier olefins. The aromatic-lean mixture via line 35 exiting the one or more contactors 605 can have a temperature of from about 25° C. (80° F.) to about 150° C. (300° F.); from about 50° C. (120° F.) to about 125° C. (250° F.); or from about 75° C. (170° F.) to about 100° C. (210° F.). In one or more embodiments, the aromatic-lean mixture via line 35 can exit the contactors 605 at a pressure of from about 100 kPa (15 psi) to about 3,000 kPa (435 psi), from about 500 kPa (75 psi) to about 2,000 kPa (290 psi), or from about 500 kPa (75 psi) to about 1,500 kPa (220 psi).

In one or more embodiments, the aromatic-rich mixture via line 640 can include about 10% wt to about 90% wt; about 30% wt to about 70% wt; or about 40% wt to about 60% wt solvent. In one or more embodiments, the aromatic-rich mixture via line 640 can include about 10% wt to about 90% wt; about 30% wt to about 70% wt; or about 40% wt to about 60% wt of the one or more aromatics.

Considering the one or more contactors 605 in detail, each contactor 605 can include any system or device suitable for contacting a solvent with the aromatic mixture via line 15 to extract one or more aromatics from the aromatic mixture via line 15. Each contactor 605 can include packing media to facilitate the extraction of at least one aromatic from the aromatic mixture via line 15. Packing media can include, for example, rings, saddles, balls, irregular sheets, tubes, spirals, trays, baffles, or any combination thereof. In one or more embodiments, the contactor 605 can operate at a temperature of about 25° C. (80° F.) to about 150° C. (300° F.); about 50° C. (120° F.) to about 125° C. (250° F.); or from about 75° C. (170° F.) to about 100° C. (210° F.). In one or more embodiments, the contactor 605 can operate at a pressure of from about 100 kPa (15 psi) to about 3,000 kPa (435 psi), from about 500 kPa (75 psi) to about 2,000 kPa (290 psi), or from about 500 kPa (75 psi) to about 1,500 kPa (220 psi).

In one or more embodiments, the aromatic-rich mixture via line 640, which can contain a mixture of solvent and aromatic hydrocarbons, can be separated using a solvent recovery system 615 to provide an aromatic-rich mixture via line 30, which can contain a mixture rich in aromatic hydrocarbons, and a solvent via line 650, which can contain a mixture rich in solvent.

In one or more embodiments, the aromatic-rich mixture via line 30 can include about 10% wt to about 90% wt; about 30% wt to about 90% wt; or about 50% wt to about 90% wt benzene, toluene, xylene, mixtures thereof, derivatives thereof, or combinations thereof. In one or more embodiments, the solvent via line 650 can include about 10% wt to about 90% wt; about 30% wt to about 90% wt; or about 50% wt to about 90% wt solvent. In one or more embodiments, at least a portion of the solvent via line 650 can be recycled to the one or more contactors 605. About 1% wt to about 100% wt; about 1% wt to about 75% wt, or about 1% wt to about 45% wt of the solvent via line 650 can be recycled to the one or more contactors 605. In one or more embodiments, from about 5% to about 80%, from about 15% to about 80%, from about 20% to about 80%, or from about 25% to about 80% of the solvent via line 650 can be recycled to the one or more contactors 605.

In one or more embodiments, the aromatic-rich mixture via line 30 can include from about 5% wt to about 95% wt, from about 10% wt to about 90% wt or from about 20% wt to about 80% wt benzene. In one or more embodiments, the aromatic-rich mixture via line 30 can include from about 5% wt to about 95% wt, from about 10% wt to about 90% wt, or from about 20% wt to about 80% wt toluene. In one or more embodiments, the aromatic-rich mixture via line 30 can include from about 5% wt to about 95% wt, from about 10% wt to about 90% wt, or from about 20% wt to about 80% wt xylene. With reference to FIG. 1, at least a portion of the aromatic-rich mixture via line 30 can be recycled to the hydrocarbon feed via line 32 and/or to the one or more separation units 10 via line 34.

The one or more solvent recovery systems 615 can include any system, device or combination of systems and/or devices suitable for separating one or more aromatics from a solvent. Illustrative systems can include, but are not limited to, gravity separation, centrifugation, distillation, or the like. In one or more embodiments, the solvent recovery system 615 can operate at a temperature of from about 25° C. (80° F.) to about 150° C. (300° F.); from about 50° C. (120° F.) to about 125° C. (250° F.); or from about 75° C. (170° F.) to about 100° C. (210° F.). In one or more embodiments, the solvent recovery system 615 can operate at a pressure of from about 100 kPa (15 psi) to about 3,000 kPa (435 psi), from about 500 kPa (75 psi) to about 2,000 kPa (290 psi), or from about 500 kPa (75 psi) to about 1,500 kPa (220 psi).

The embodiments also include the process where a portion of the aromatic lean mixture is recycled to one unit and a portion of the aromatic lean unit is saturated to produce paraffins for recycle to another unit designed to crack paraffins. This process is useful as a way to destroy the C4 and naphtha materials, especially in a petrochemical complex.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for producing one or more olefins, comprising:

cracking a feed comprising 90% by weight or more C4 and higher hydrocarbons at conditions sufficient to provide an olefinic mixture comprising 90% by weight or more C1 to C3 hydrocarbons and an aromatic mixture comprising 90% by weight or more C4 and higher hydrocarbons and one or more aromatics;

contacting a first portion of the aromatic mixture with one or more solvents to provide an aromatic-rich mixture and an aromatic-lean mixture;

recycling at least a portion of the aromatic-lean mixture to the feed prior to cracking; and separating a second portion of the aromatic mixture to provide a low aromatics mixture and gasoline.

2. The process of claim 1, wherein the aromatic-rich mixture comprises 50% by weight or more of the one or more aromatics from the aromatic mixture.

3. The process of claim 1, wherein the aromatic-rich mixture comprises 75% by weight or more of the one or more aromatics from the aromatic mixture.

4. The process of claim 1, wherein the aromatic-rich mixture comprises 90% by weight or more of the one or more aromatics from the aromatic mixture.

5. The process of claim 1, wherein the aromatic-rich mixture comprises 95% by weight or more of the one or more aromatics from the aromatic mixture.

6. The process of claim 1, wherein the aromatic-lean mixture comprises 10% by weight or less aromatics.

7. The process of claim 1, wherein the aromatic-lean mixture comprises 5% by weight or less aromatics.

8. The process of claim 1, wherein the solvent comprises di-methyl sulfoxide, n-methyl pyrrolidone, alkyl carbonates, derivatives thereof, or mixtures thereof.

9. The process of claim 1, wherein the feed comprises one or more untreated hydrocarbons, unrefined hydrocarbons, treated hydrocarbons, refined hydrocarbons, derivatives thereof, or mixtures thereof.

10. The process of claim 1, further comprising saturating the recycled aromatic-lean mixture with hydrogen prior to mixing with the feed.

11. A process for producing one or more olefins, comprising:

cracking a feed comprising 90% by weight or more C4 and higher hydrocarbons into one or more cracked hydrocarbons comprising one or more linear olefins and aromatics;

selectively separating the cracked hydrocarbons to provide an olefinic mixture comprising 20% by weight or more olefins and an aromatic mixture comprising 80% by weight or more C4 and higher hydrocarbons and one or more aromatics;

contacting a first portion of the aromatic mixture with one or more solvents to selectively separate at least a portion of the one or more aromatics from the aromatic mixture into the one or more solvents providing an aromatic-lean mixture comprising 30% by weight or more olefins and 10% by weight or less aromatic hydrocarbons;

selectively separating at least a portion of the one or more aromatics from the solvent;

recycling at least a portion of the aromatic-lean mixture to the feed; and separating a second portion of the aromatic mixture to provide a low aromatics mixture and gasoline.

12. The process of claim 11, wherein the solvent comprises di-methyl sulfoxide, n-methylpyrrolidone, alkyl carbonates, derivatives thereof, or mixtures thereof.

13. The process of claim 11, wherein separating the one or more aromatics from the solvent comprises extraction, distillation, gravity separation, centrifugation, or any combination thereof.

14. The process of claim 11, wherein selectively separating the cracked hydrocarbons comprises:

fractionating the cracked hydrocarbons to provide a first mixture comprising heavy naphtha, light cycle oil, slurry oil, derivatives thereof, or mixtures thereof and a second mixture comprising two or more C2-C10 olefins;

treating the second mixture to remove oxygenates, acid gases, water, or any combination thereof to provide a treated mixture comprising two or more C2-C10 olefins; and selectively separating the treated mixture to provide the olefinic mixture and the aromatic mixture.

15. The process of claim 14, further comprising:

selectively separating the olefinic mixture to provide a first fraction comprising 30% by weight or more methane and a second fraction comprising 30% by weight or more C2 and C3 hydrocarbons; and recycling at least a portion of the first fraction to the feed.

16. The process of claim 11, further comprising:

selectively separating the aromatic mixture to provide a first fraction comprising 5% by weight or more benzene, toluene, xylene, or combinations thereof and a second fraction comprising C6 and higher linear hydrocarbons; and recycling at least a portion of the first fraction to the feed.

17. The process of claim 16 further comprising selectively separating the second fraction to provide a C2-rich mixture comprising 50% by weight or more ethylene and a C3-rich mixture comprising 50% by weight or more propylene.

18. The process of claim 17 further comprising:

selectively separating the C2-rich mixture to provide an ethylene-rich product comprising 60% by weight or more ethylene and an ethane-rich product comprising 60% by weight or more ethane;

recycling at least a portion of the ethane-rich product to the feed; and recovering at least a portion of the ethylene-rich product.

19. The process of claim 17 further comprising:

selectively separating the C3-rich mixture to provide a propylene-rich product comprising 60% by weight or more propylene and a propane-rich product comprising 60% by weight or more propane;

recycling at least a portion of the propane-rich product to the feed; and recovering at least a portion of the propylene-rich product.

20. The process of claim 14, further comprising:

cracking a refinery feed comprising gas oil, full range gas oil, resid, or any combination thereof to provide a cracked refinery feed comprising 5% by weight or more olefins; and combining at least a portion of the cracked refinery feed with the cracked hydrocarbons.

21. A process for producing one or more olefins, comprising:

cracking a feed comprising 90% by weight or more C4 and higher hydrocarbons into one or more cracked hydrocarbons comprising one or more linear olefins and aromatics;

selectively separating the cracked hydrocarbons to provide an olefinic mixture comprising 20% by weight or more olefins and an aromatic mixture comprising 80% by weight or more C4 and higher hydrocarbons and one or more aromatics;

contacting a first portion of the aromatic mixture with a solvent comprising di-methyl sulfoxide, n-methylpyrrolidone, alkyl carbonates, derivatives thereof, or mixtures thereof to selectively separate at least a portion of the one or more aromatics from the aromatic mixture into the one or more solvents to provide an aromatic-lean mixture comprising 30% by weight or more olefins and 10% by weight or less aromatic hydrocarbons and an aromatic-rich mixture comprising aromatics and solvent;

selectively separating at least a portion of the one or more aromatics from the aromatic-rich mixture to provide an aromatic-rich mixture comprising 20% by weight or more benzene, toluene, xylene, or combinations thereof, and a solvent comprising the solvent with less than 20% by weight benzene, toluene, xylene, or combinations thereof;

recycling at least a portion of the aromatic-lean mixture to the feed;

recycling at least a portion of the aromatic-rich mixture to the feed; and separating a second portion of the aromatic mixture to provide a low aromatics mixture and gasoline.

* * * * *